US009825400B2

(12) United States Patent
Clingman et al.

(10) Patent No.: US 9,825,400 B2
(45) Date of Patent: Nov. 21, 2017

(54) SIDE-EXIT MOTOR CABLE CONNECTIONS

(71) Applicant: Baker Hughes Incorporated, Houston, TX (US)

(72) Inventors: James C. Clingman, Broken Arrow, OK (US); Sean A. Cain, Tulsa, OK (US); Spencer Wilcox, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 252 days.

(21) Appl. No.: 14/804,382

(22) Filed: Jul. 21, 2015

(65) Prior Publication Data

US 2016/0024854 A1 Jan. 28, 2016

Related U.S. Application Data

(60) Provisional application No. 62/027,481, filed on Jul. 22, 2014.

(51) Int. Cl.

| | |
|---|---|
| ***H01R 13/52*** | (2006.01) |
| ***H01R 13/621*** | (2006.01) |
| ***E21B 43/12*** | (2006.01) |
| ***E21B 17/02*** | (2006.01) |
| *H01R 13/523* | (2006.01) |

(52) U.S. Cl.

CPC ..... *H01R 13/6215* (2013.01); *E21B 17/025* (2013.01); *E21B 17/026* (2013.01); *E21B 43/128* (2013.01); *H01R 13/5219* (2013.01); *H01R 13/523* (2013.01)

(58) Field of Classification Search

CPC ..... H01R 13/523
USPC ..... 439/271, 902, 694, 855, 881
See application file for complete search history.

(56) References Cited

U.S. PATENT DOCUMENTS

| | | | | |
|---|---|---|---|---|
| 5,186,644 | A * | 2/1993 | Pawlicki | B60G 17/015 439/271 |
| 5,595,496 | A * | 1/1997 | Konda | H01R 13/5219 439/271 |
| 6,666,708 | B2 * | 12/2003 | Saito | H01R 12/727 439/372 |
| 2013/0040480 | A1 * | 2/2013 | Frey | F04B 47/06 439/199 |

* cited by examiner

*Primary Examiner* — Tho D Ta
(74) *Attorney, Agent, or Firm* — Law Offices of Mark L. Berrier

(57) ABSTRACT

Systems and methods for connecting power cables to downhole equipment such as ESPs using side-exit (radial) connections. In one embodiment, a system includes an electric drive coupled by a power cable to an ESP. The electric drive is positioned at the surface of a well with the power cable coupled to it. The power cable extends into the well bore and is coupled to the downhole equipment which is positioned in the well bore. The power cable has a connector with a first set of radially oriented terminals (the terminals are perpendicular to the conductors of the power cable). These terminals engage a second set of terminals that are installed in the downhole equipment. The radial orientation of the terminals of the connector and downhole equipment allow the power cable to remain axially oriented, thereby facilitating engagement of the terminals and requiring less annular space in the well bore.

15 Claims, 5 Drawing Sheets

SIDE-EXIT MOTOR CABLE CONNECTIONS

CROSS-REFERENCE TO RELATED APPLICATIONS

This application claims the benefit of U.S. Provisional Patent Application 62/027,481, filed Jul. 22, 2014 by Clingman et al, which is incorporated by reference as if set forth herein in its entirety.

BACKGROUND

Field of the Invention

The invention relates generally to downhole electric equipment, and more particularly to systems and methods for improving the reliability and ease of installation of electrical connections between power cables and downhole electric equipment such as electric submersible pumps (ESP's).

Related Art

Electric submersible pump (ESP) systems are commonly positioned within subterranean wells and used to pump fluids from the wells. Power suitable to drive the ESP systems is produced at the surface of the wells and is delivered to the ESP systems via power cables that extend into the wells. The power cables are typically spliced to motor lead extensions (heavy gauge conductive wires), which are in turn connected to the motor of the ESP using a "pothead" connector.

Conventionally, a motor lead extension extends along the exterior of the ESP from near the top of the ESP to the motor. At the top of the motor, the motor lead extension is curved inward so that the pothead connector at the end of the motor lead extension can be coupled to the motor head. The motor head is normally configured to accept the pothead connector at an angle with respect to the axis of the system in order to facilitate the connection of the pothead to the motor head. The connection is angled to accommodate the position of the pothead as the stiff motor lead extension is curved inward toward the connection on the motor head.

Although the angled connection of the pothead to the motor head relieves the problem of the motor lead extension affecting the orientation of the pothead, it can cause several other problems. For instance, the motor lead extension and pothead have some weight and therefore tend to hang straight down. Consequently, it is necessary for the installer to manually reorient the pothead to the angle of the motor head interface. As noted above, the motor lead extension is very stiff, and it may be difficult to accurately position the pothead to correctly engage the motor head.

Another, related problem is that, because the pothead connector is angled with respect to the axis of the motor, the connector extends outward, radially, beyond the outer diameter of the motor and into the annulus between the motor and the casing of the well. Further, the motor lead extension, which is aligned with the pothead connector, also extends outward beyond the outer diameter of the motor and into the annulus between the motor and the casing. As a result of the pothead and the motor lead extension extending beyond the outer diameter of the motor, the equipment designer must either reduce the size of the motor to accommodate this, or risk of damage to the pothead or motor lead extension when the motor is installed in the narrow annulus in the well.

Yet another problem is that the connection between the pothead and the motor head may be damaged in the process of trying to align and secure these components. More specifically, the insulation block ("i-block") that is positioned in the motor head to provide insulation between the conductors at the pothead interface may be very brittle, and an attempt to secure a misaligned pothead to the motor may crack the i-block. The i-block may then fail to provide the necessary electrical isolation of the conductors, which can result in shorting of the conductors and failure of the motor.

Another problem with conventional pothead connectors is that the interface between the connector and the motor housing provides only a small area for sealing. Typically, a relatively small, annular seal is positioned around a portion of the pothead connector that plugs into the motor housing. Also, conventional pothead connectors are typically secured to the motor housing by a pair of bolts on opposite sides of the plug-in portion of the connector. As the pothead connector becomes more slender and as the spacing of the bolts increases, the deflection of the connector housing increases, resulting in reduced contact pressure on the sealing surface of the connector. The use of only two bolts in the conventional design may also require increasingly large bolts to provide the desired preload, but the amount of space for these bolts is decreasing as motor diameters are reduced.

SUMMARY OF THE INVENTION

This disclosure is directed to systems and methods for connecting power cables to downhole equipment such as ESPs using side-exit (radial) connections. In one particular embodiment, a system includes an electric drive coupled by a power cable to a piece of downhole equipment such as an ESP. The electric drive is positioned at the surface of a well with the power cable coupled to it. The power cable extends into the well bore and is coupled to the downhole equipment which is positioned in the well bore. The power cable has a connector with a first set of radially oriented terminals (the terminals are perpendicular to the conductors of the power cable). These terminals engage a second set of terminals that are installed in the downhole equipment. The radial orientation of the terminals of the connector and downhole equipment allow the power cable to remain axially oriented, thereby facilitating engagement of the terminals and requiring less annular space in the well bore.

In one embodiment, the connector and the downhole equipment have complementary sealing surfaces between which a fluid tight seal is formed. A gasket may be positioned between the sealing surfaces to improve the seal. The sealing surfaces may be substantially flat and may be axially oriented, allowing for a much greater sealing area than conventional pothead connectors. This also allows the connector to be secured to the equipment housing with more (e.g., three or more) bolts or other fasteners than conventional potheads, thereby reducing deflection and improving contact pressure across the sealing surfaces. The connector may be positioned within a recess in the housing of the downhole equipment in order to reduce the amount of annular space required by the connector.

An alternative embodiment comprises a method for electrically coupling a power cable to a piece of downhole equipment such as an ESP. In this method, a power cable is provided, where the lower end of the power cable has a side-exit (radial) connector. This connector has a set of terminals that are oriented perpendicularly to the power cable so that they face radially inward toward the ESP. The ESP has a complementary set of terminals that are configured to be electrically coupled to (e.g., mate with) the terminals of the connector. The terminals of the ESP face generally radially outward. The power cable, which is oriented parallel to the axis of the ESP (and the well bore) is positioned with the connector radially outward from the terminals of the ESP. The connector is then moved radially inward toward the ESP to engage its terminals with those of the ESP. When the terminals have been engaged with each other, the connector is secured to the ESP's housing, forming a seal between the two. A gasket or the like may be positioned between the connector and the ESP housing to provide a better seal.

Numerous other embodiments are also possible.

BRIEF DESCRIPTION OF THE DRAWINGS

Other objects and advantages of the invention may become apparent upon reading the following detailed description and upon reference to the accompanying drawings.

Figure 1:
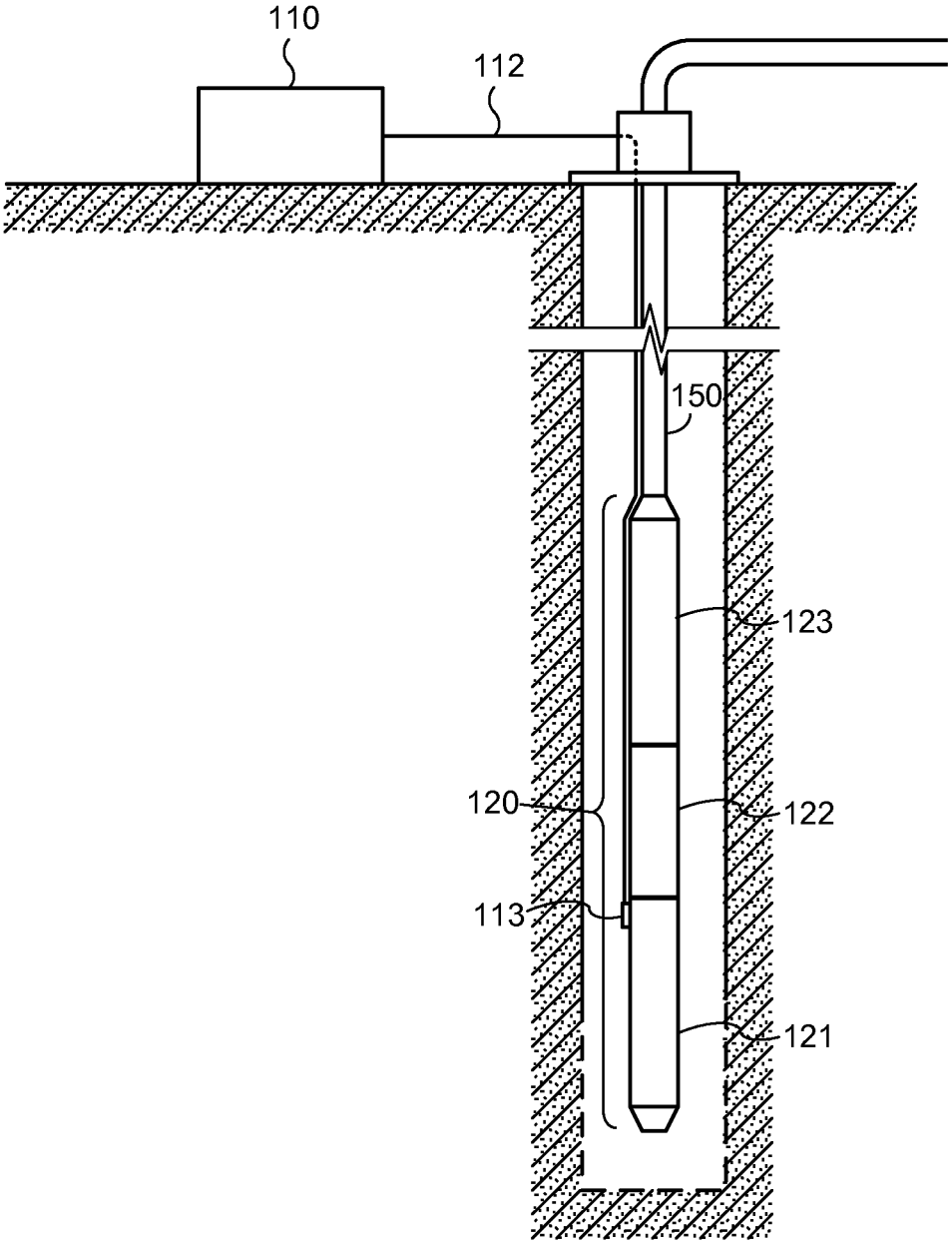
FIG. 1 is a diagram illustrating an exemplary ESP system in accordance with one embodiment.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as defined by the appended claims. Further, the drawings may not be to scale, and may exaggerate one or more components in order to facilitate an understanding of the various features described herein.

DETAILED DESCRIPTION OF EXEMPLARY EMBODIMENTS

One or more embodiments of the invention are described below. It should be noted that these and any other embodiments described below are exemplary and are intended to be illustrative of the invention rather than limiting.

As described herein, various embodiments of the invention comprise systems and methods for coupling the power cable of an ESP system to the motor of the system in a manner that reduces or eliminates one or more of the problems described above. This is accomplished by utilizing a side-exit (radial) configuration of the connector pins that extend through the housing of the motor head, in conjunction with a connector at the end of the motor lead extension that is configured to engage the connector pins radially (i.e., horizontally as the connector and motor leads are suspended vertically).

Referring to FIG. 1, a diagram illustrating an exemplary system in accordance with one embodiment of the present invention is shown. In this embodiment, an ESP system is installed in a well for the purpose of producing oil, gas or other fluids. An ESP 120 is coupled to the end of tubing string 150, and the ESP and tubing string are lowered into the well bore to position the ESP in a producing portion of the well (as indicated by the dashed lines at the bottom of the well bore). Surface equipment which includes a drive system 110 is positioned at the surface of the well. Drive system 110 is coupled to ESP 120 by power cable 112, which runs down the well bore along tubing string 150. Tubing string 150 and power cable 112 may range from less than one thousand feet in a shallow well, to many thousands of feet in a deeper well.

In this embodiment, ESP 120 includes a motor section 121, seal section 122, and pump section 123. ESP 120 may include various other components which will not be described in detail here because they are well known in the art and are not important to a discussion of the invention. Motor section 121 is operated to drive pump section 123, thereby pumping the oil or other fluid through the tubing string and out of the well. Drive system 110 produces power (e.g., three-phase AC power) that is suitable to drive motor section 121. This output power is provided to motor section 121 via power cable 112.

Power cable 112 includes a primary cable that extends downward along the tubing string from the drive unit at the surface of the well to a point near the ESP. At this point (typically 10-50 feet above the ESP), the primary cable is connected (e.g., spliced) to a motor lead extension. The motor lead extension runs from the primary cable to the motor, and is connected to the motor by a connector 113. In a conventional system, connector 113 is a "pothead" that is positioned at the top of the motor and is oriented at an angle of around 10-15 degrees with respect to the axis of the motor in order to accommodate the gradual curve of the stiff conductors that extend from the motor lead extensions, essentially straight through the pothead, and then into the motor. In the present systems, however, the connection between the motor lead extensions and the conductors within the motor form relatively sharp angles, thereby reducing or eliminating problems associated with bend the motor leads. For example, the present systems may use a side-exit connector which has conductive pins that are connected at right angles to the motor lead extensions and internal motor leads. This may also be referred to as a radial connection because the terminals that connect the motor lead extensions to the internal wiring of the motor extend radially through the interface between the connector and the motor head.

For the purposes of this disclosure, the terms "axis" will be used to refer to the longitudinal axis of the well bore. The ESP and cable are considered to be substantially coaxial with the well bore. The term "axial" and similar terms will be used to refer to directions substantially parallel to the axis of the well bore. The term "radial" and similar terms will be used to refer to directions substantially perpendicular to the axis of the well bore. Radial directions do not necessarily intersect the axis of the well bore.

Figure 2:
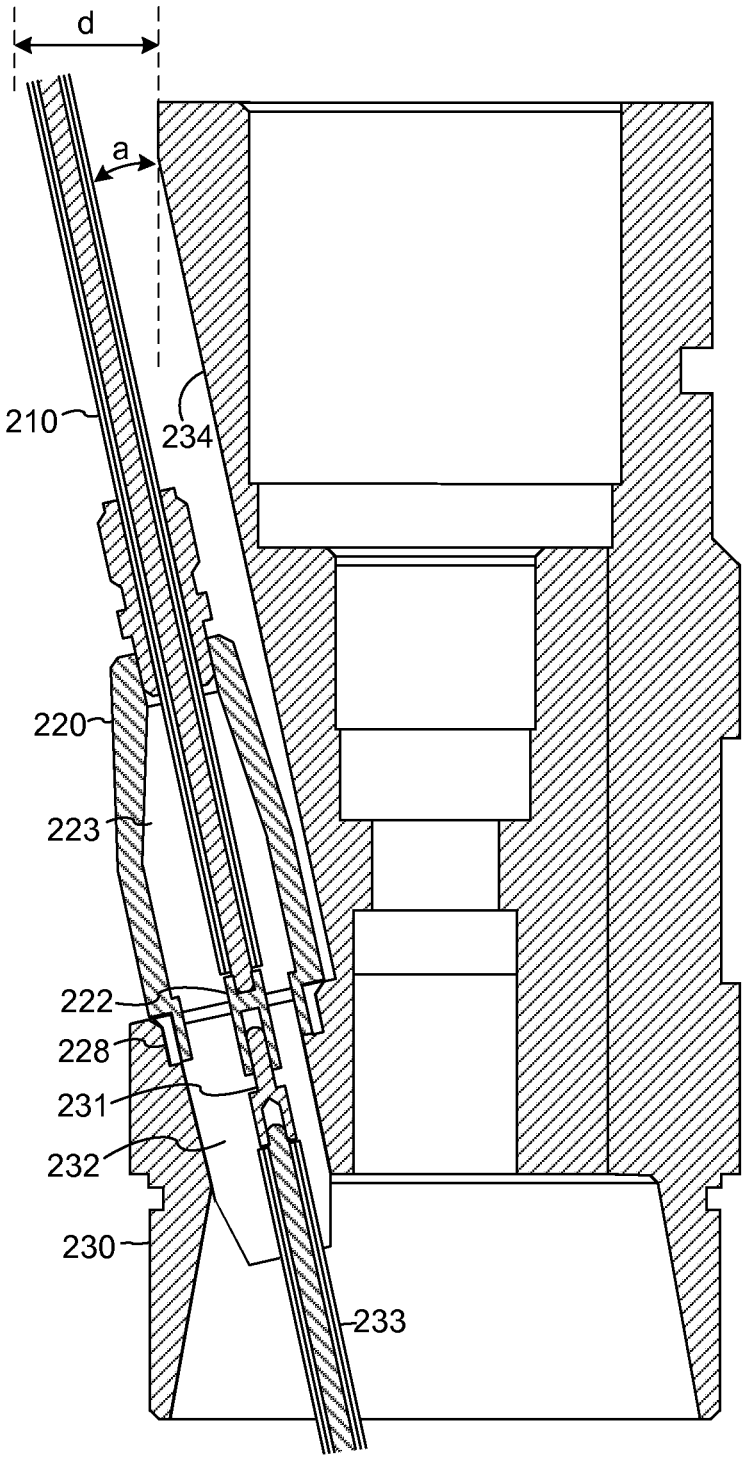
FIG. 2 is a diagram illustrating a cutaway view of an exemplary conventional pothead connector installed at the top of an ESP motor.

Before describing exemplary embodiments of the present invention, it may be helpful to illustrate a conventional pothead connection. Referring to FIG. 2, a cutaway view of an exemplary pothead connector installed at the top of an ESP motor is shown. In this example, motor lead 210 is coupled to pothead connector 220, which is secured to motor head 230. Motor head 230 has an angled recess 234 within which the pothead connector is positioned.

The electrical conductor of the motor lead is encased in a layer of electrical insulation. A layer of polymeric or metallic material of low permeability may cover the insulating layer, and a protective metal layer may be provided to prevent damage to the motor lead when the motor is installed in the well. The conductor of the motor lead passes through the top of the pothead connector, and the end of the conductor is connected within the body of the pothead connector to a conductive female terminal 222 positioned at a lower end of the connector. Insulating engineered material 223 provides mechanical strength and electrical insulation to keep the conductors in position and electrically isolated. A polymeric seal is made against the insulating engineered material and the insulation of the conductor. Female terminal 222 is configured to mate with a male terminal 231 of motor head 230. An insulating block ("i-block") insulates the male terminal from the housing of motor head 230. Male terminal 231 is electrically coupled to the internal wiring 233 of the motor. A seal 228 is provided between a lower portion of pothead connector 220 and motor head 230.

It can be seen from FIG. 2 that the motor lead extensions, which are positioned at the exterior of the ESP, must be curved inward to be connected via the pothead to the internal motor leads within the housing of the motor head. The stiffness of the motor lead extensions can make it difficult to curve the motor lead extensions and properly orient the pothead connector. This may result in installation difficulties, as well as damage to the i-block or other components of the connection. Additionally, because the motor lead extensions extend outward from the motor head and into the annulus between the motor head and the well casing as they extend upward (because the pothead connector is angled away from the axis of the motor), they may take up more space than if they were positioned axially against the outer diameter of the ESP. In other words, a larger well bore is required.

Figure 3A:
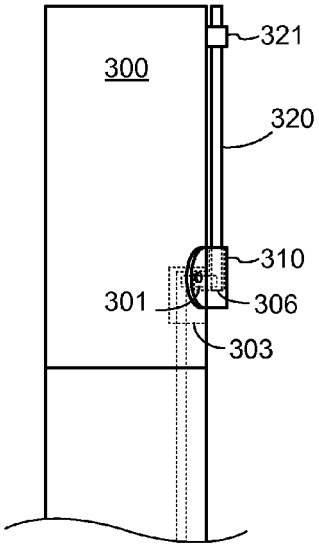
FIGS. 3A-3E are diagrams illustrating an exemplary embodiment of a surface-mount, side-exit connection between a power cable and an ESP.

FIGS. 3A-5B show several exemplary embodiments of the present invention. Referring to FIGS. 3A-3E, a surface-mount, side-exit connection is illustrated. FIGS. 3A-3B depict the upper portion of an ESP motor and the coupling of a set of motor lead extensions (MLE's) which are external to the motor housing to the motor leads which are internal to the motor housing. FIGS. 3C-3E depict the structure of the components of the side-exit connector in one embodiment.

In the embodiment of FIGS. 3A-3E, the motor head 300 has a cylindrical exterior that does not have a recess for a connector. Instead, a connector 310 is positioned against the cylindrical outer surface of the motor head. Motor lead extensions 320 are positioned axially along the exterior of motor head 300 and extend directly downward to connector 310. Connector 310 is coupled to a set of connector pins (e.g., 301) that extend radially through the side of the motor head. The connector pins are electrically connected to the conductors of motor lead extensions 320. At the interior of the motor head, a right-angle connection couples the connector pins to the motor leads of the stator.

In the embodiment of FIGS. 3A-3E, the connector pins are installed in the side of motor head 300. (The connector pins could alternatively be installed in the connector 310 with female terminals in the motor head 300.) Electrical insulators are installed in the motor head to electrically isolate the connector pins from the motor head and from each other. The insulators may accommodate the connector pins individually or as a unit. The electrical insulators are configured to extend through the motor head, thereby increasing the tracking path between the connector pins and components such as the housing of motor head, to which the pins may potentially be shorted.

Connector 310 is configured to engage the connector pins radially (horizontally or left-to-right in the figures) while the motor lead extensions are extended axially (vertically or top-to-bottom in the figures). As noted above, this configuration eliminates the need to manually reposition the connector from an axial orientation in order to engage the connector pins. In one embodiment, the pins are configured to mate with corresponding sockets in the connector. In other embodiments, the pins may be positioned in the motor and designed to engage corresponding terminals of the connector in a face-to-face configuration, or in some other manner. After connector 310 engages the connector pins, the connector is secured to the motor head. The connector may be secured using a variety of means, such as screws, nuts and studs, clamping bands, and the like.

Figure 3B:
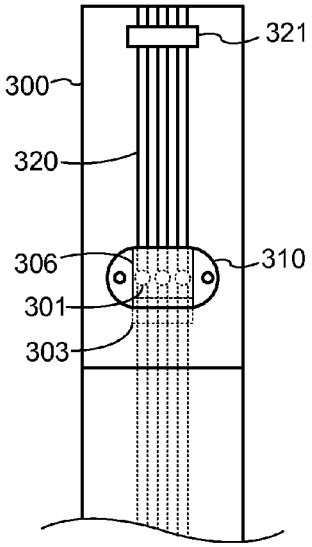
Figure 3C:
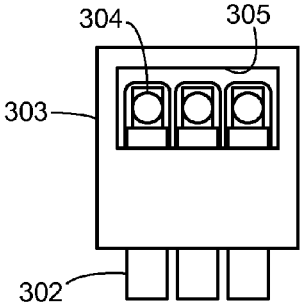
Figure 3D:
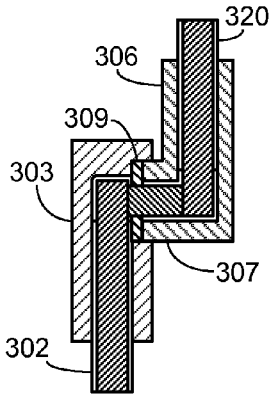
Figure 3E:
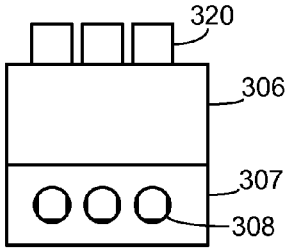

Referring to FIGS. 3C-3E, the structure of the connector components is shown in more detail. FIG. 3D shows a cross-sectional view of the assembled components. Within the housing of the motor head, motor leads (e.g., 302) extend from the windings of the motor's stator to an insulator block 303. Connector pins (e.g., 304) are connected within the insulating block to the ends of each of the motor leads. In this embodiment, the connector pins form right angles with the motor leads. Insulator block 303 has an opening 305 in its face which exposes the connector pins, allowing them to be coupled to the motor lead extensions 320.

Each of the motor lead extensions (e.g., 320) extends (vertically in the figure) into an MLE insulator block 306, which is nested within the portion of connector 310 that is secured to the motor housing. MLE insulator block 306 has a nose 307 that extends laterally (horizontally in the figure) from the body of the MLE insulator block. Nose 307 is shaped to fit within the pocket formed by opening 305 in insulator block 303. Holes (e.g., 308) are formed in nose 307 to accommodate the connector pins (e.g., 304) that extend outward from the insulator block 303 in the motor head. When MLE insulator block 306 is mated with motor head insulator block 303, the connector pins extend through the holes to electrically couple the motor leads (e.g., 302) to the motor lead extensions (e.g., 320). An insulating plate 309 may be positioned between the nose of MLE insulator block 306 and motor head insulator block 303 to increase the tracking path in the connection.

When connector 310 is secured to motor head 300, the assembly is more compact than a system with a conventional pothead connection. As shown in FIG. 2, the angle (a) of the pothead from an axial orientation causes the motor lead extensions to extend outward by some distance (d) from the exterior surface of the motor head. In the embodiment of FIGS. 3A-3E, the motor lead extensions are axially oriented, so the only additional space that is required is approximately the width of the motor lead extensions themselves. Small protectors (e.g., 321) that may be positioned on the motor lead extensions to prevent them from being damaged by contact with the well bore and/or the housing of the motor head may slightly increase the required space. Since the motor with the installed side-exit connector is more compact overall than a motor with a conventional pothead connector, the motor itself may be designed to be slightly larger than the conventional motor.

Figure 4A:
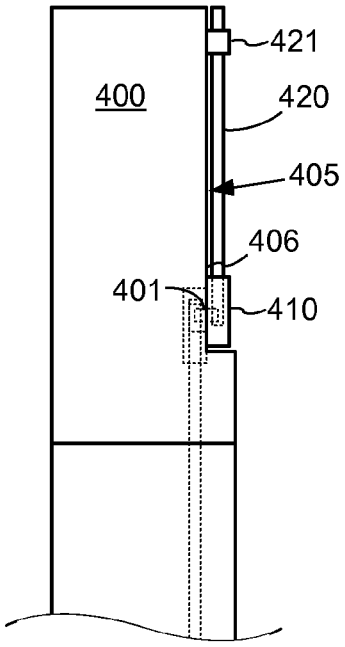
FIGS. 4A-4B are diagrams illustrating an alternative exemplary embodiment of a side-exit connection between a power cable and an ESP.
Figure 4B:
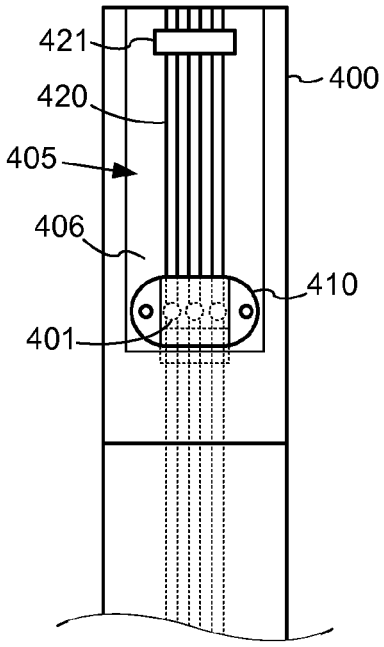

Referring to FIGS. 4A-4B, an alternative embodiment of a side-exit connection is illustrated. In this embodiment, the exterior surface of motor head 400 has a recess 405 that accommodates a connector 410. Recess 405 extends to the top of the motor head in this embodiment to allow motor lead extensions 420 to extend vertically from connector 410. The motor lead extensions and connector can therefore remain axially oriented. As in the embodiment of FIGS. 3A-3B, connector 410 is coupled to a set of connector pins (e.g., 401) that extend radially through the side of the motor head at the bottom of recess 405. The connector pins are electrically coupled by connector 410 to the conductors of motor lead extensions 420. Within the interior of motor head 400, right-angle connections electrically couple the connector pins to the motor leads of the motor's stator.

The connector pins in this embodiment are installed with electrical insulators that electrically isolate the connector pins from the motor head and from each other. The electrical insulators are designed to extend through the motor head to increase the tracking path between the connector pins and other conductive components such as the motor head housing. Connector 410 is configured to engage the radially extending connector pins while it and the motor lead extensions are axially oriented. Since the weight of the motor lead extensions and connector normally maintains the connector in this orientation, this facilitates proper engagement of connector 410 with the connector pins in motor head 400.

As in the embodiment of FIGS. 3A-3B, the specific configuration of the connector and connector pins may vary in different embodiments. The connector components and structure may, for example, be similar to those shown in FIGS. 3C-3E. When connector 410 is engaged with the connector pins, the connector is secured to the motor head using bolts, screws, nuts and studs, clamping bands, or other suitable fasteners.

The embodiment of FIGS. 4A-4B provides the same advantages associated with the embodiment of FIGS. 3A-3E. For instance, the connector is easily aligned with the connector pins to facilitate assembly, the length of the electrical tracking path at the connection is increased, and the connection is less complex than a pothead connection. As noted above, the system is also more compact than a system that uses a conventional pothead connection. Since the motor head in this embodiment has a recess which accommodates the connector, it is even more compact than the embodiment of FIGS. 3A-3B.

Figure 5A:
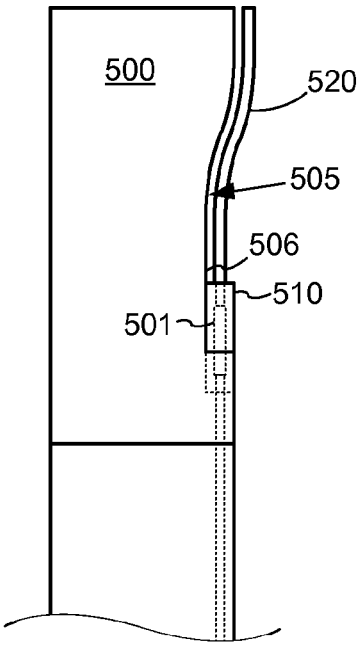
FIGS. 5A-5B are diagrams illustrating an alternative embodiment of a connection between a power cable and an ESP where the terminals of the connector and ESP are axially aligned.
Figure 5B:
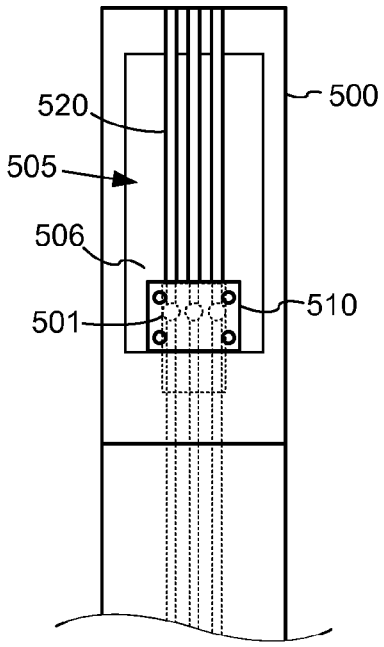

Referring to FIGS. 5A-5B, a different configuration of the connection is illustrated. In this embodiment, motor head 500 has a recessed portion 505 similar to the embodiment of FIGS. 4A-4B, but the connector pins (e.g., 501) are oriented axially at the bottom of the recess, rather than radially. In order to facilitate proper engagement of connector 520 with the connector pins, the lower portion of the motor head that forms the wall 506 of recess 505 is parallel to the pins, and connector 520 is configured so that it can be positioned against wall 506 and then slid downward into engagement with the pins. The contact between connector 520 and wall 506 maintains the lateral positioning and alignment of the connector with the connector pins. After the connector and connector pins have been fully engaged, the connector can be secured to the motor head using screws, nuts and studs, clamping bands, or other means. In this embodiment, screws extend radially into the motor head to secure connector 520 against wall 506.

In this embodiment, electrical insulators are installed around the connector pins in a manner similar to the previously described embodiments. The connector configuration in this embodiment would, however, maintain the axial alignment of the conductors, rather than making the right angles of the side-exit configurations of FIGS. 3A-3E and 4A-4B. The insulators extend through the motor head and electrically isolate the connector pins from the motor head and from each other. The electrical insulators extend through the motor head and provide a longer tracking path than conventional pothead connections. This configuration also has the advantage of being less complex than a conventional pothead connection, and the connection may be more compact than the conventional pothead connection.

Figure 6A:
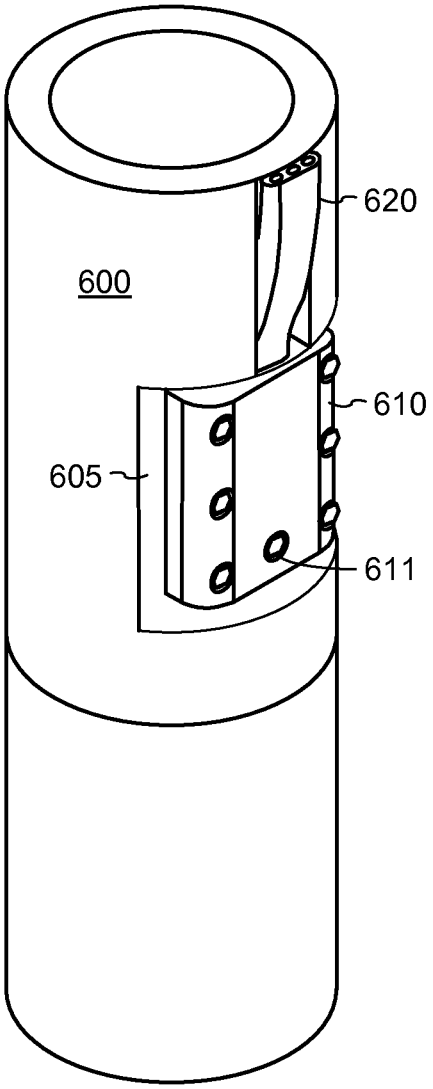
FIGS. 6A-6B are diagrams illustrating an alternative exemplary embodiment of a side-exit connection between a power cable and an ESP.
Figure 6B:
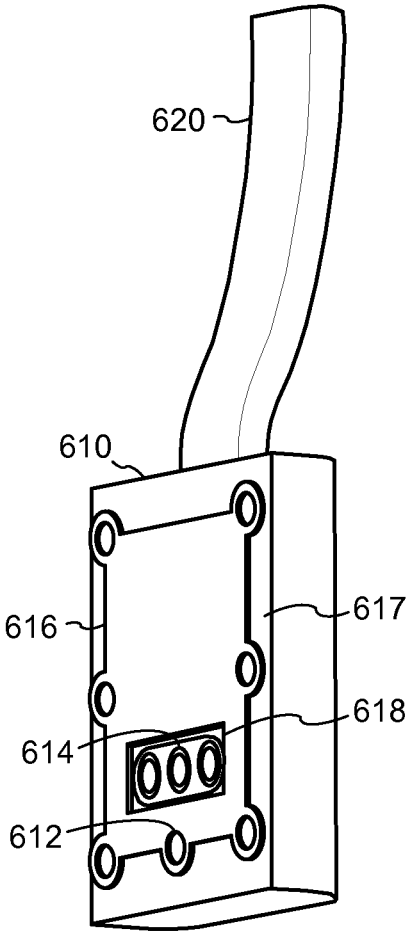

Referring to FIGS. 6A-6B, another alternative configuration of the connection is illustrated. FIG. 6A is a perspective view of a side-exit pothead connector installed on a motor head. FIG. 6B is a perspective view of the uninstalled pothead connector. As depicted in FIG. 6B, pothead connector 610 is connected to the end of motor lead extensions 620. The conductors of the motor lead extensions are electrically coupled to a corresponding set of female terminals (e.g., 614) in the pothead connector. It can be seen that, although the terminals are aligned horizontally (left-to-right) in the figure, there is enough room to move the positions of the terminals axially (top-to-bottom) as well, thereby providing increased spacing between the phases. The female terminals are accessible through an opening 618 in a side of pothead connector 610 that faces the motor head (600 in FIG. 6A). The female terminals are configured to accept male terminals (not shown) that extend radially outward from an opening in the motor head, similar to the configuration of FIGS. 3A-4B.

This side of pothead connector 610 has a flat surface 617 that abuts a corresponding flat surface of motor head 600 (within recess 605) when the pothead connector is installed on the motor head. The sealing surfaces of motor head 600 and pothead connector 610 in this embodiment are substantially parallel to the axis of the motor. A portion of the recess extends upward to accommodate motor lead extensions 620 and allows the pothead connector and motor lead extensions to lie flat against the motor, which reduces the amount of annular space occupied by the system. A gasket 616 is positioned on surface 617 to provide a seal between pothead connector 610 and motor head 600. Pothead connector 610 is wide enough to allow placement of multiple bolt holes (e.g., 612) around the connector (between opening 618 and the outer edges of the connector), so that multiple fasteners (e.g., bolts 611) can be used to secure the connector to motor head 600.

The embodiment of FIGS. 6A-6B has a number of advantages over conventional pothead designs. For example, as noted above, the pothead connector lies flat against the motor and takes up less annular space in the well than conventional potheads. The wide, flat sealing surface and gasket in the embodiment of FIGS. 6A-6B also provides much more sealing area than a conventional design and is a much more forgiving design, as it is less prone to tears and pinches. The seal configuration in this embodiment also allows a wider range of gasket materials to be used (in comparison to traditional materials). Additionally, the use of more than two bolts (seven are used in this embodiment) allows smaller bolts to be used (which saves space), and provides less deflection and a more evenly distributed clamping load (which provides better contact pressure on the sealing surfaces). Still further, the wide sealing face of the pothead connector allows wider terminal spacing than can be achieved in conventional pothead connectors. In particular, the additional area between the connector and the motor allows terminals to be spaced axially, which provides greater phase separation than conventional pothead connectors.

As noted above, the specific embodiments described herein are exemplary, and many variations of the described features may be incorporated into other embodiments that fall within the scope of the claims. For instance, rather than using gaskets to seal the connector against the motor, other sealing means, such as o-rings, rubber boots, etc., can be used as alternatives to, or in combination with gaskets. Alternative embodiments may also use different types of fasteners to secure the connector to the motor. For example, clamps, straps/banding, tack welding, threaded or quick-connect fasteners may be used. In still another variation, the components may use snap-together construction which requires no fasteners at all.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the described embodiments. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the described embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed within the descriptions herein.

What is claimed is:

1. A system comprising:

an electric drive positioned at the surface of a well;

a power cable coupled to the electric drive and extending into a well bore of the well; and a piece of downhole equipment positioned in the well bore and coupled to the power cable, wherein power from the electric drive is supplied to the downhole equipment;

wherein the power cable is coupled to the downhole equipment by a connector having a first set of terminals that engage a second set of terminals in the downhole equipment;

wherein the power cable is oriented in the well bore in a direction that is substantially parallel to the well bore, wherein a set of conductors of the power cable extend into the connector in the direction that is substantially parallel to the well bore, and are electrically connected to the first set of terminals, and wherein at least one of the first and second sets of terminals extends between the connector and the downhole equipment in a direction that is substantially perpendicular to the well bore.

2. The system of claim 1, wherein the downhole equipment comprises an electric submersible pump.

3. The system of claim 1, wherein the first set of terminals are electrically connected to corresponding conductors of the power cable within the connector, and wherein the first set of terminals form right angles with the conductors of the power cable.

4. The system of claim 1, wherein the connector has a first sealing surface and the downhole equipment has a second sealing surface, wherein when the first and second sealing surfaces form a fluid tight seal between the connector and the downhole equipment.

5. The system of claim 4, the wherein first and second sealing surfaces are substantially planar and are parallel to the well bore.

6. The system of claim 4, further comprising a gasket positioned between the first and second sealing surfaces.

7. The system of claim 4, wherein the second sealing surface is formed by a recess in an outer surface of a housing of the downhole equipment, wherein the recess forms the second sealing surface, and wherein the second sealing surface is substantially planar and is parallel to the well bore.

8. The system of claim 4, further comprising fasteners that are positioned at three or more points around an outer portion of the connector, wherein the fasteners secure the connector to the downhole equipment.

9. The system of claim 8, wherein the first and second sealing surfaces are substantially planar and are parallel to the well bore and the fasteners are perpendicular to the well bore.

10. A method for electrically coupling a power cable to a piece of downhole equipment, the method comprising:

providing a power cable, wherein the power cable is oriented in the well bore in a direction that is substantially parallel to the well bore, wherein the power cable terminates in a connector, wherein a set of conductors of the power cable extend into the connector in the direction that is substantially parallel to the well bore, and are electrically connected to a first set of terminals that are oriented in a direction that is substantially perpendicular to the well bore;

providing a piece of downhole equipment, wherein the downhole equipment has a second set of terminals that are oriented perpendicularly to an axis of the downhole equipment;

orienting the power cable parallel to the axis of the downhole equipment;

positioning the connector radially outward from the downhole equipment so that the first set of terminals are radially aligned with the second set of terminals; and radially engaging the first set of terminals with the second set of terminals.

11. The method of claim 10, further comprising securing the connector to the downhole equipment with a first sealing surface of the connector contacting a second sealing surface of the downhole equipment, wherein first and second sealing surfaces are substantially planar and are parallel to the well bore, wherein the first and second sealing surfaces form a fluid tight seal between the connector and the downhole equipment.

12. The method of claim 11, further comprising positioning a gasket positioned between the first and second sealing surfaces.

13. The method of claim 11, wherein securing the connector to the downhole equipment comprises positioning three or more fasteners around an outer portion of the connector and tightening the fasteners to secure the connector to the downhole equipment.

14. The method of claim 11, wherein first and second sealing surfaces are parallel to the well bore.

15. The method of claim 11, further comprising positioning the connector in a recess in an outer surface of a housing of the downhole equipment, wherein the second sealing surface is formed by the recess.

* * * * *